United States Patent [19]

Conway

[11] 4,139,766

[45] Feb. 13, 1979

[54] APPARATUS AND METHOD FOR COUNTING FRUITS AND OTHER OBJECTS

[75] Inventor: Tim D. Conway, Berkeley, Calif.

[73] Assignee: Sunkist Growers, Inc., Sherman Oaks, Calif.

[21] Appl. No.: 824,396

[22] Filed: Aug. 15, 1977

[51] Int. Cl.[2] ..... G06M 7/00

[52] U.S. Cl. ..... 235/92 PK; 235/92 V; 235/92 R; 235/98 C

[58] Field of Search ..... 235/92 PK, 92 PC, 92 V, 235/98 C; 340/146.3 MA, 146.3 Y, 146.3 J, 146.3 F; 250/222 PC, 224, 237 R

[56] References Cited

U.S. PATENT DOCUMENTS

| | | | |
|---|---|---|---|
| 3,408,485 | 10/1968 | Scott et al. | 235/92 PK |
| 3,692,980 | 9/1972 | Getker et al. | 235/92 PK |
| 3,878,323 | 4/1975 | Fisher | 235/92 PC |
| 3,964,022 | 6/1976 | Martin | 340/146.3 J |

*Primary Examiner*—Joseph M. Thesz
*Attorney, Agent, or Firm*—Paul A. Weilein

[57] ABSTRACT

Apparatus and method for the counting of objects and in particular fruits such as oranges, grapefruit, lemons, and the like, which are randomly continuously presented by a conveyor or other means to a counting area in which the objects are illuminated. An image of the counting area and illuminated objects is optically reproduced on a self-scanning photodiode array which generates a series of output analog video signals corresponding to the light intensity on each of the photodiodes. These analog signals are amplified and compared with a voltage that is approximately 60% of the peak voltage value from the array, to provide an output binary signal pulse having a digital logic value of "1", when the video signal is above the 60% value, and a value of "O" when below the 60% value. Logic circuits group certain of the output binary signal pulses into a predetermined group recognition pattern having a configuration such that it will occur only once for each object that it scanned, and which is decoded to provide an output counting pulse for each object presented to the counting area.

25 Claims, 8 Drawing Figures

APPARATUS AND METHOD FOR COUNTING FRUITS AND OTHER OBJECTS

PRIOR ART

In the prior art there are numerous apparatus for electronically counting particles, packages, and other objects, wherein the objects are directly scanned by a light beam. The closest art known comprise the following U.S. patents:

U.S. Pat. No. 2,948,469 — Aug. 9, 1960
U.S. Pat. No. 3,692,980 — Sept. 19, 1972
U.S. Pat. No. 3,867,613 — Feb. 18, 1975
U.S. Pat. No. 3,869,083 — Mar. 4, 1975

BACKGROUND OF THE INVENTION

The present invention relates generally to the field of art concerned with an apparatus and method for the counting of objects and more particularly pertains to the counting of fruits and other objects which are randomly continuously passed through a counting area.

Heretofore, it has been generally known in the fruit packing industry to provide a variety of counting machines for oranges, grapefruit and the like in which the fruit is moved by a conveyor through grading, sizing and counting mechanisms prior to packing or boxing for shipment. Improvements on these machines then followed, as exemplified by U.S. Pat. No. 3,500,982, in which fruit is diverted from a conveyor into a counting machine and into a single-file arrangement in three parallel lanes each of which is provided with a fruit switch actuated arm arranged to be tripped by a fruit as it is discharged from the lane. The fruit in the lanes is discharged therefrom at staggered time intervals and a timing cam is provided to successively briefly close a circuit to a counter through each of the fruit switches at similar staggered time intervals and thereby attain a count for each fruit that is discharged from the machine.

From a consideration of the above noted conventional counting machines in the fruit packing industry, it became evident that there was an existing need for a reliable and dependable but simplified machine which could be utilized for rapidly and accurately electronically counting the objects or fruit, without the necessity of having to utilize mechanically actuated switches or other means which were operable by engaging the fruit. A survey of electronic type counters indicated that such counters, as exemplified by the prior art patents previously listed above, had been developed for the counting of fine particles such as might be found in dust clouds, and the like, as disclosed in U.S. Pat. No. 2,948,469; for the counting of objects such as parcels as disclosed in U.S. Pat. No. 3,692,980; particle detection apparatus for determining the number and size of particles present in a plurality of particles dispersed over a field, as disclosed in U.S. Pat. No. 3,867,613; and apparatus as used in biomedical fields for determining the number of discrete objects in an assemblage, as disclosed in U.S. Pat. No. 3,869,083. The counting techniques in these patents were generally broadly similar in that line-by-line scanning light means were utilized to scan the field containing the parcels or particles, and by suitable sensing means and logic circuitry to provide a count of the objects. Although these patents are suggestive of electronic counting apparatus and methods which might possibly be modified or used to count fruit, such adaptations do not appear to have been made in available counting apparatus for the fruit industry.

According to the present invention, the objects or fruits to be counted are randomly continuously moved through an illuminated counting area, an optical image of the area and illuminated fruit being optically applied to a photodiode self-scanned array which generates a series of analog signals representative of the light levels collected from the associated divisional areas of the image of the counting area. A peak signal detector stores the maximum value video voltage signal. A percentage scaling network is used to generate a voltage which is approximately 60% of the peak value, which is compared to the video signal in order to determine the presence or absence of a fruit in the counting area. By such comparison, the circuitry is designed to produce digital logic binary signal pulses having digital logic values of "1" and "0". These binary signals for a previous scan of the photodiode array are stored, and certain of these stored values are combined with certain present scan binary signals in a recognition pattern which occurs once for each fruit or object which passes through the counting area. When such pattern occurs and is decoded, a count output signal is generated for each fruit or object passing through the counting area.

SUMMARY OF THE INVENTION

It is one object of the herein described invention to provide improved apparatus and method for more simply and reliably, but less expensively, counting objects and primarily fruits having a general spheroidal or ellipsoidal configuration, which are continuously and randomly passed through a counting area.

A further object resides in the provision of an improved counter for objects, particularly citrus and other appropriate types of fruit, as they are randomly moved through a counting area, and in which the counting may be accomplished without the use of mechanical means requiring actuation by physical contact with the object.

A further object is to provide an electronic type counter for objects, in which the objects are presented in an illuminated counting area embraced by a self-scanning photodiode array such that the photodiodes generate output analog pulse signals corresponding to the illumination levels of similar discrete grid areas of the counting area.

A further object is to provide an electronic type counter in which the objects to be counted are carried by a conveyor belt into an illuminated counting area, and in which a dark background underlies the illuminated objects.

A still further object is to provide an object counter of the herein described type in which the objects are carried by a conveyor belt into an illuminated counting area that extends transversely of the conveyor belt, and in which unique means are provided to attenuate the illuminating light rays from a single light source positioned above the conveyor belt in such a manner that a generally uniform light intensity will be obtained across the conveyor belt within the counting area.

Another object is to provide a fruit counter in which the fruits are randomly passed through an illuminated counting area, in which a sensor generates video signal pulses which are compared to a percentage of its own peak value, whereby reliable operation will be assured even though different varieties of fruit might reflect different amounts of light, or the amount of illumination on the counting area may fluctuate due to voltage variations in the electric supply circuit connected to the source of illumination.

Still another object is to provide a counter for objects moved into an illuminated counter area, wherein an image of the counting area and the objects therein is optically reproduced on a self-scanning photodiode array for the generation of analog pulse signals corresponding to the illumination levels sensed by each diode, in which each analog signal pulse is compared with a predetermined illumination level to determine binary pulse values for each object in a predetermined recognition pattern are decoded to provide a count pulse for each object.

It is also an object to provide an improved counter for objects in which binary signal pulse values representative of illumination levels above and below a predetermined value of illumination, are determined for discrete grid areas of each object, and in which logic circuit means groups certain of the binary signal pulse values into a recognition pattern having a configuration such that it will occur only once for each object.

Further objects and advantages of the invention will be brought out in the following part of the specification, wherein detailed description is for the purpose of fully disclosing the preferred embodiment of the invention without placing limitations thereon.

BRIEF DESCRIPTION OF THE DRAWINGS

Referring to the accompanying drawings, for illustrative purposes only.

DESCRIPTION OF THE DISCLOSED EMBODIMENT

Figure 1:
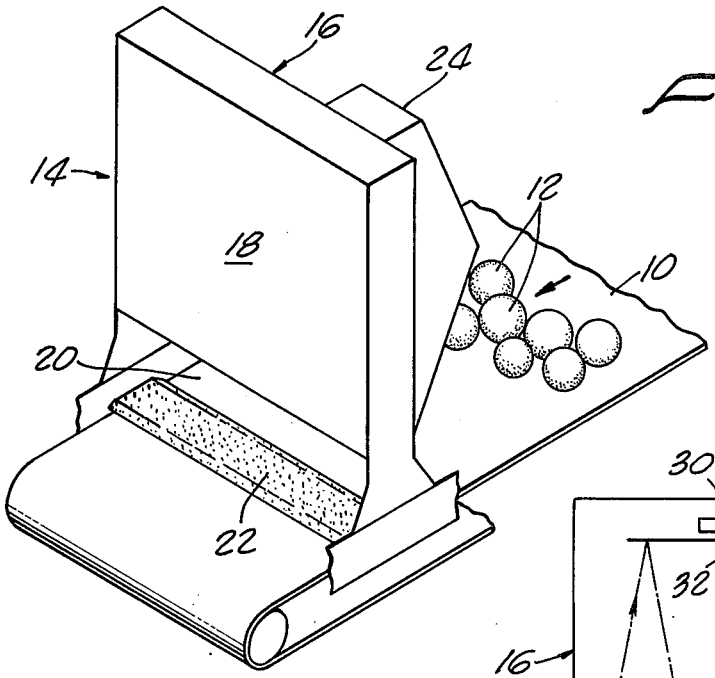
FIG. 1 is a fragmentary perspective view diagrammatically illustrating apparatus embodying the basic features of the present invention.

Referring more specifically to the drawings, for illustrative purposes, the present invention is shown generally in FIG. 1 as comprising a conventional conveyor belt 10 for continuously carrying a plurality of randomly arranged objects, which are shown in this case as comprising fruits 12 such as lemons, oranges, grapefruit or the like, to a counting station, as generally indicated by the numeral 14.

The counting apparatus is shown as basically comprising an appropriate upstanding housing structure 16 which is preferably constructed with a generally rectangular portion 18 which is supported on suitable framing so as to transversely bridge the conveyor. The housing portion 18 has a bottom opening 20 which is positioned above a counting area of generally rectangular configuration, which extends transversely across the conveyor belt 10, and through which the fruit on the conveyor will be randomly moved.

The housing structure is further formed with a rearwardly extending portion 24 which provides an elevated support for a light source 26 of appropriate type to preferably provide a substantially uniform illumination of the counting area. In practice, a single 300 watt tungsten-halogen electric lamp has been used as the light source.

The lowermost ends of the housing sections have their interiors interconnected and so configured as to permit radiating light rays 28, as shown in full lines, to divergingly emanate from the light source 26 and pass through the bottom opening 20 in a manner to illuminate all the fruit as they pass through the counting area. Dimensionwise, the size of the counting or viewing area is in this case approximately one-half inch wide and 24 inches long so as to extend entirely across the conveyor belt.

An important consideration in the operation of the present invention is concerned with the provision of means which will provide a dark background for the illuminated fruit or other objects in the viewing or counting area, and which will be effective even though the belt conveyor may have a relatively high reflective surface.

Mechanically, the dark background may be obtained by the provision of a thin fixed plate member 22 of a suitable material having a relatively dark exposed upper surface. This plate member is supported so as to extend over the upper surfaces of the conveyor belt 10 in the counting area below the bottom opening 20 of the housing structure. As thus arranged, the conveyed fruit or objects entering the counting area will be moved over the plate member 22.

Figure 2:
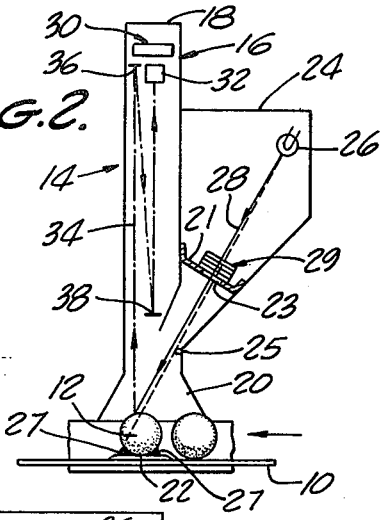
FIG. 2 is a view diagrammatically illustrating the paths of the illuminating and reflected light rays as seen from one side of the apparatus.

A preferred optical arrangement, however, as illustrated in FIG. 2, permits the elimination of the plate member 22. In this arrangement, the housing structure portion 24 is constructed to provide a transversely extending internal partition 21 having an elongate, generally rectangular aperture 23 which serves to confine the transmitted illuminating rays from the light source into a rectangular beam of an appropriate size to illuminate the fruit or objects in the counting area, and through the use of a transversely extending edge lip portion 25 of the housing structure provide a transversely extending shadow area 27 across the conveyor belt surface in the counting area below the illuminated surfaces of the fruit or objects. It will be apparent that the use of the above described shadow technique, will provide proper operation with any conveyor belt, irrespective of its reflective characteristics.

Figure 3:
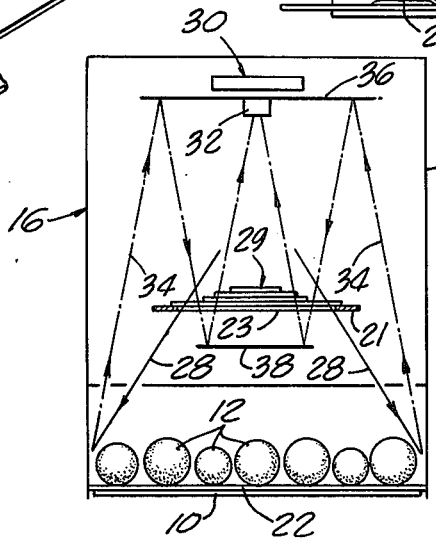
FIG. 3 is a view diagrammatically illustrating the path of the light rays as viewed in right angled relation to that of FIG. 2.

Another important consideration for proper operation of the present invention, is concerned with the provision of illumination which will be substantially uniform in the counting area transversely of the conveyor, and particularly in the case of a single light source positioned above the longitudinal center line of the belt conveyor 10. It will be apparent, that the diverging rays from such a single light source would normally provide illumination of greater intensity at the center of the conveyor belt and gradually decrease to illumination of least intensity at the sides of the conveyor belt. Unique means are illustrated in FIG. 2 for progressively decreasingly attenuating the light rays outwardly from the center to the sides of the conveyor belt 10. For such purpose, a series of stacked commercially available textured glass plates, as indicated generally by numeral 29, are positioned over the slit aperture 23. For illustrative purposes, these plates are shown in FIG. 3 as comprising four plates with the shortest at the top, and progressively increasing in length to the longest at the bottom. It is to be understood, however, that the relative lengths of the plates and the number of plates may be varied depending upon the plate material used and the corrective tolerance required.

An image of the counting area and fruit being conducted therethrough is optically applied to a sensor device 30 at the top of the housing portion 18, by means of an appropriate focusing lens 32. This lens is arranged to convergingly receive the reflected light rays 34 from the counting area, as shown in phantom lines. In order to keep the housing structure 16 at a practical height, the path of the light rays 34 may be redirected by mirrors 36 and 38, which are appropriately positioned within the rectangular portion 18 of the housing structure. Also, it will be noted that the light source 26 is so positioned that the emitted rays therefrom will be confined to a path which is inclined from the vertical at an angle of approximately 30°.

The sensor device 30 is commercially available and is of the photodiode self-scanning type. While this type of photodiode array device is well known in the industry, a brief description will be helpful in understanding the present invention. The device contains a row of 64 or more photodiodes which operate in the charge storage mode and are discharged by photo-generated current at a rate proportional to the local light intensity. Since the local light intensity is in the present invention determined by the image of the counting area which is focused on the diode array, the light intensity at each photodiode will correspond to a similar discrete area of the counting area. It will be apparent that the light levels in the respective areas will vary as the fruits or objects are moved through the counting area, and such changes will be reflected in the operation of the photodiodes.

The photodiodes are accessed in sequence by a shift counter within the device, and a series of analog charge pulses will be generated as a video output, each of the pulses having a magnitude proportional to the light intensity on the corresponding photodiode.

Figure 7:
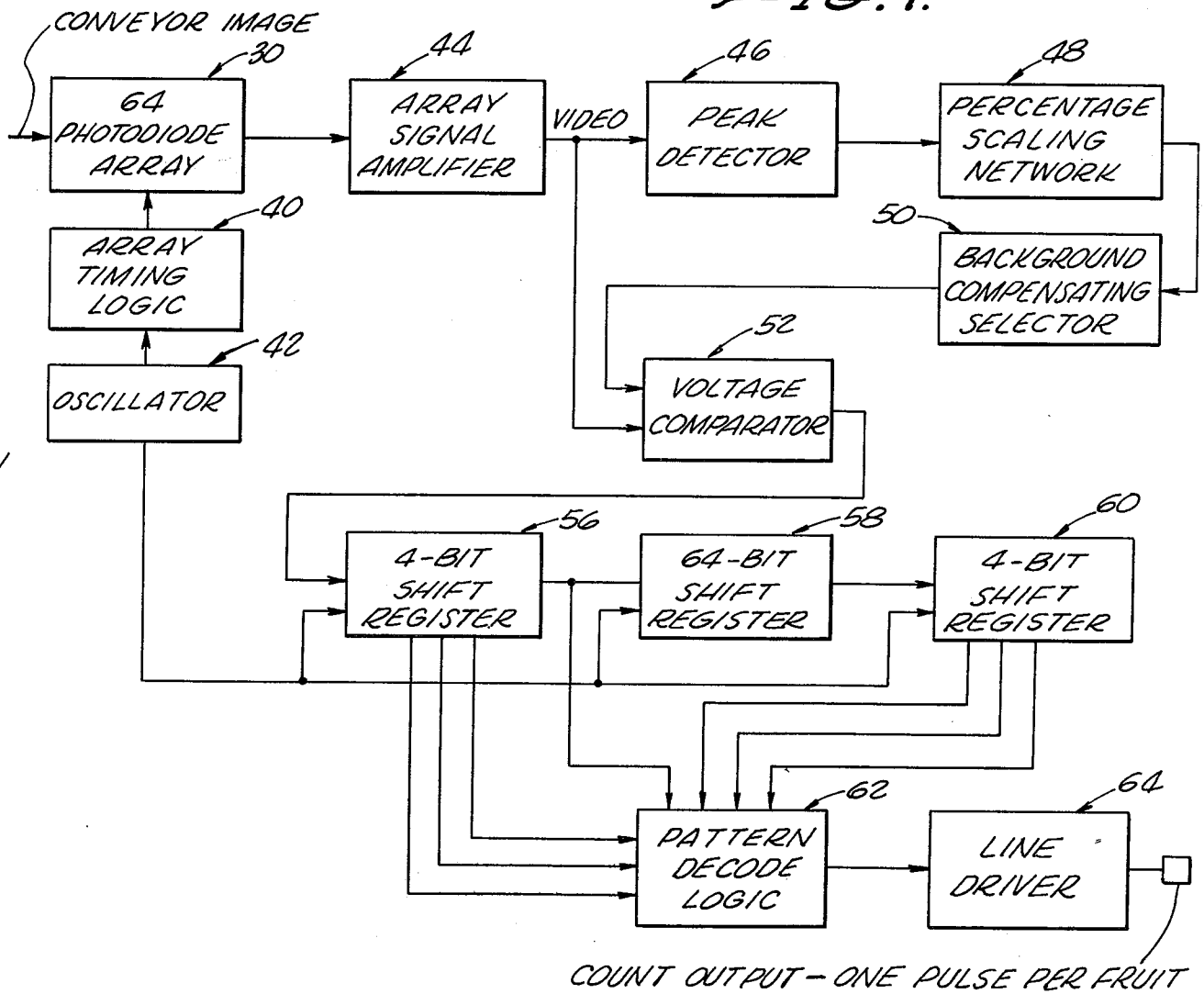
FIG. 7 is a schematic block diagram for the circuitry as utilized in the present invention.

The photodiode array of the sensor device requires connected means for supplying timing signals to the photodiode array, and is shown in the block diagram of FIG. 7 as comprising appropriate array timing logic, as indicated by the numeral 40, and which is connected with an oscillator 42 which generates a square timing wave of the appropriate frequency. This oscillator also provides timing pulses for the digital logic circuitry, as hereinafter referred to. The photodiode array, oscillator, and timing logic (30, 40, 42 and 44) are contained on a small commercially available circuit board.

Figure 4:
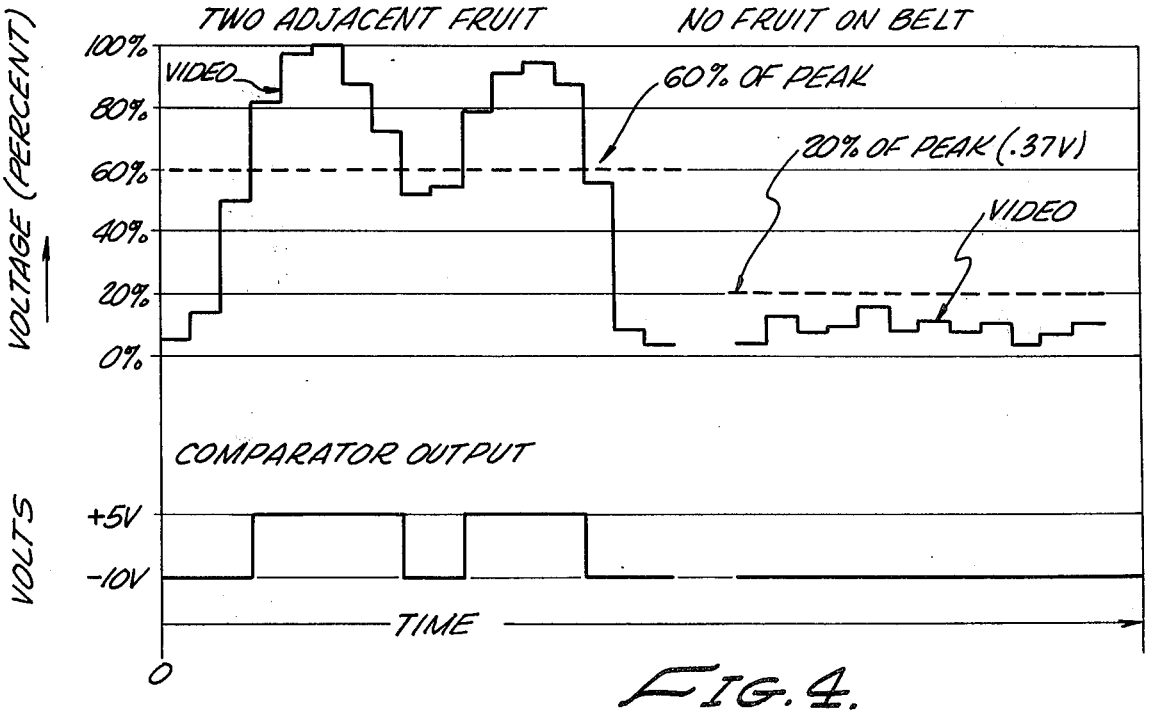
FIG. 4 is a view graphically illustrating typical video patterns for fruit and no fruit conditions in relation to corresponding comarator outputs.

Referring to the typical video patterns shown in FIG. 4, the variations in the analog output signals from the photodiode array are illustrated for "fruit" and "non-fruit" conditions. The analog signals range from approximately 1.5 to 2.0 volts maximum which corresponds to the amount of light falling on each photodiode in the array. It will be seen that in the case where there are two adjacent fruits, for example, on the conveyor, there will be a group of signal readings for each fruit which are above a 60% peak value. In the case where there is no fruit on the conveyor belt, the analog output signals from the array will have values which are below a 20% peak value.

Figure 8:
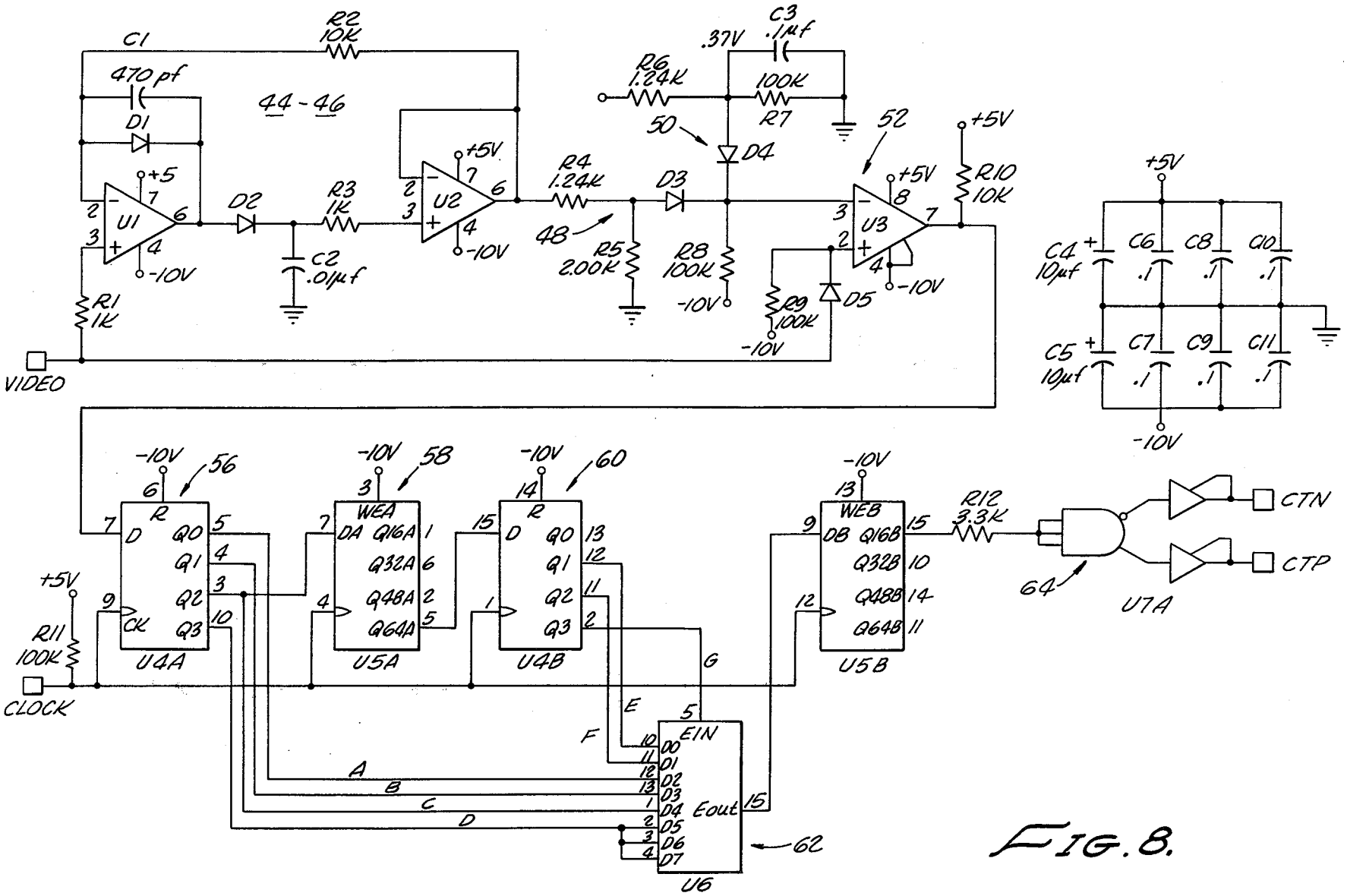
FIG. 8 is a more detailed wiring diagram view of the circuitry shown in FIG. 7.

Referring now to FIGS. 7 and 8, it will be seen that the output analog signals from the photodiode array are conducted to an array signal amplifier 44 and peak detector 46 in which the amplifiers U1 and U2 coact to amplify the analog signal pulses and to store the peak voltage value of each scan in the capacitor C2. This peak value also appears at the output terminal 6 of the amplifier U2.

A percentage scaling network 48 comprises the resistors R4 and R5 which are connected between the output terminal 6 or amplifier U2 and ground to generate a voltage which is approximately 60% of the stored peak value. This voltage is eventually compared in a voltage comparator 52 with the received video signals in order to determine the presence or absence of fruit in the counting area. A background compensating selector 50 includes a compensating circuit in which the diodes D3 and D4 prevent the peak voltage from decreasing to zero when there is no fruit being viewed in the counting area, and will instead hold the signal to a value of approximately 0.37 volts.

The voltage comparator 52 comprises the circuit module U3 which has input connections with the percentage scaling network and the video signal output, and functions to compare the level of the video signal to the scaled peak value. As shown in FIG. 4, the comparator output will correspond to a +5 volt value when the video signal is above 60% of its normal peak value, and an output voltage of −10 volts when the video signal is less than 60% of its peak value. These output values respectively correspond to the binary digital logic values of "1" and "0", which will hereinafter be utilized in the digital logic circuitry for determining an output pulse count for each of the fruits or objects appearing in the counting area. The purpose of the digital logic circuitry is to store the binary signals corresponding to each scan of the photodiode array, and to combine certain of the stored previous scan binary signals with certain present scan binary signals into a recognition pattern which occurs only once for each fruit or object passing through the counting area. When the predetermined pattern occurs, it is then decoded to provide the count output signal.

Figure 5:
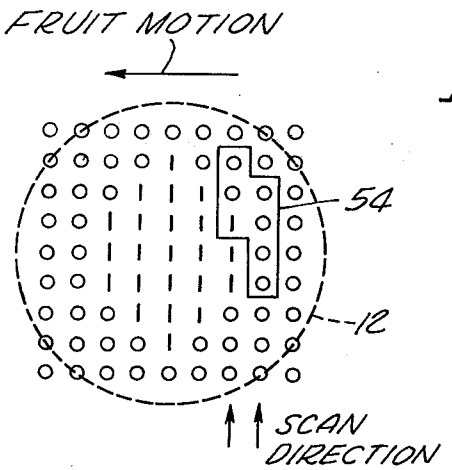
FIG. 5 is a view diagrammatically illustrating a typical pattern of generated binary signals in relation to a scanned fruit.

A typical pattern of logic signal levels as generated at the output of U3 for a three inch diameter fruit is shown in FIG. 5, wherein the +5 volts output pulse is represented by the binary value "1" and the −10 output pulse is represented by the binary value "0".

Figure 6:
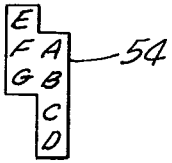
FIG. 6 is a view diagrammatically illustrating the output elements of the recognition output pattern for each fruit.

An important feature of the present invention consists in the discovery that certain of the output signals in the pattern shown in FIG. 5 can be grouped into a recognition pattern as indicated at 54. For purposes of discussion, the signals in this group pattern have been indicated in FIG. 6 by the letters A to G. As will subsequently appear, provision is made in the digital logic circuitry for taking the pattern elements A, B, C, and D from a present scan, while the elements E, F, and G are taken from a previous scan.

Referring again to the block diagram, it will be seen that the binary output signals from the voltage comparator 52 are accumulated and stored in shift registers 56, 58 and 60. These shift registers are represented in the circuit diagram of FIG. 8, respectively, by the modules U4A, U5A and U4B. The 4-bit shift register 56 selects and stores the four binary value signals A, B, C, and D of the recognition pattern from a present signal scan.

The 64-shaft register has the ability to store all 64 of the binary signal values for a single scan, and its output is the logic value for the previous scan for the same photodiode that is appearing at its input. The 4-bit shift register 60 is connected to the output of the 64-bit register and thus permits the signal values E, F and G of the recognition pattern to be supplied from the previous scan of the photodiode array.

The seven elements of the recognition pattern are fed into a pattern decode logic device 62 which comprises the module U6 which will have an E out binary signal value of "1" only when the element G is "1" and all of the elements A-F are "0". Since the illustrated recognition pattern occurs only once for each fruit which passes through the counting area, the E out signal of the decoding device will constitute a single count for each fruit.

The output from the decode logic device 62 is fed to a line driver circuit block 64 consisting of circuit module U7A which permits the count pulses to be transmitted over a long cable to remotely positioned count indicating and recording means, or for other purposes.

As further shown in FIG. 8, a shift register U5B may be inserted in the E out connection to the line driver 64 to eliminate spurious signals which might occur during the input signal transitions of U6.

Components as used in the circuitry of the herein disclosed invention and their corresponding part numbers are listed as follows:

| COMPONENT | PART NO. |
|---|---|
| PHOTODIODE ARRAY 30 | RETICON CORPORATION |
| TIMING LOGIC 40 | RL-64P |
| OSCILLATOR 42 | |
| SIGNAL AMPLIFIER 44 | |
| DIODES D1-D5 | 1N 4152 |
| | BURR-BROWN |
| U1 | BB 3500 |
| U2 | BB 3552 |
| | NATIONAL SEMICONDUCTOR CORP. |
| U3 | LM 211 |
| | MOTOROLA SEMICONDUCTOR PRODUCTS, INC. |
| U4A | ½ MC 14015 |
| U4B | ½ MC 14015 |
| U5A | ½ MC 14517 |
| U5B | ½ MC 14517 |
| U6 | MC 14532 |
| | FAIRCHILD CAMERA AND INSTRUMENT CORP. |
| U7A | UA 9614 |

From the foregoing description and drawings, it will be clearly evident that the delineated objects and features of the invention will be accomplished.

Various modifications may suggest themselves to those skilled in the art without departing from the spirit of the herein disclosed invention and, hence, it is not wished to be restricted to the specific form shown or uses mentioned, except to the extent indicated in the appended claims.

What is claimed is:

1. Apparatus for counting generally spheroidal or ellipsoidal objects randomly continuously moved across a fixed elongate transverse counting area, comprising:

(a) means for illuminating the objects within the confines of said counting area;

(b) means for successively scanning the counting area in a single fixed scanning path extending longitudinally of the counting area as the objects are moved across the counting area, and for generating successive timed binary signal pulses during each scan corresponding to the respective illumination levels of successively scanned discrete areas of each object, said signal pulses having a digital logic value of "1" when the illumination level of a scanned area varies in one direction with respect to a predetermined value, and a digital logic value of "0" when the illumination level varies in an opposite direction with respect to said predetermined value; and (c) logic circuit means for grouping certain of said binary signal pulse values, as generated during successive scans of each object, into a recognition pattern having a configuration such that it will occur only once for each object scanned, and for decoding the binary values in said pattern to provide an output counting pulse for each object presented to the counting area.

2. Apparatus as set forth in claim 1, in which the logic value is "1" when the illumination level is greater than the predetermined value, and "0" when less than the predetermined value.

3. Apparatus as set forth in claim 1, in which the means for illuminating the objects includes an elevated fixed light source, and hood means for confining the light rays from said source to diverging path terminating in an elongate relatively narrow emission opening above the counting area.

4. Apparatus as set forth in claim 3, in which the counting area is of elongated rectangular configuration; and the light rays are confined by a generally rectangular slit aperture positioned between the light source and the counting area so as to illuminate the objects presented in the counting area.

5. Apparatus as set forth in claim 4 in which the light source is centrally positioned of the long axis of said slit aperture; and including means positioned in the diverging light rays from said source for progressively decreasingly attenuating said light rays outwardly from the center of the slit aperture to provide a substantially uniform level of illumination in said counting area.

6. Apparatus as set forth in claim 5, in which the attenuating means comprises a series of stacked plates of textured glass extending over said slit aperture, said plates being longitudinally centered on the central axis of said slit aperture and of progressively increasing lengths.

7. Apparatus as set forth in claim 4, which includes an elongated housing lip portion extending into the light rays from said light source above said counting area to provide an elongated shadow area in the counting area and provide a dark background for the illuminated objects therein.

8. Apparatus as set forth in claim 3 in which the path of the light rays is vertically inclined.

9. Apparatus as set forth in claim 1, in which the successive scans of the counting area correspond to a plurality of longitudinally and transversely aligned grid areas of a grid array embracing the counting area.

10. Apparatus as set forth in claim 1, in which the scanning means comprises a sensor having a selfscanning photodiode line array, and in which an image of the counting area and illuminated objects therein is optically reproduced in reduced size on said array.

11. Apparatus according to claim 10, in which the photodiode array comprises at least 64 photodiode elements.

12. Apparatus as set forth in claim 10, in which the light rays from the counting area and the illuminated objects converge to lens means for focusing the image on said photodiode array.

13. Apparatus as set forth in claim 12, in which the path of the rays between the counting area and the lens means contains a series of light rays redirecting mirrors.

14. Apparatus as set forth in claim 1 in which the objects in the counting area are supported on a surface which provides a relatively dark background for the illuminated objects.

15. Apparatus as set forth in claim 1, in which the scanning means output comprises a series of analog voltage signals corresponding to the illumination levels of the successively scanned areas of each scan of the object; and in which said generating means comprises a comparator for comparing each of said analog signals with an analog voltage signal corresponding to said predetermined value.

16. Apparatus as set forth in claim 15, in which amplifier circuit means connected to receive said analog signals selects and stores the analog peak signal of each scan; and a scaling network connected to the output of said amplifier circuit means generates the voltage corresponding to said predetermined value.

17. Apparatus as set forth in claim 16, in which the voltage corresponding to said predetermined value is substantially 60% of the voltage value of said analog peak signal.

18. Apparatus as set forth in claim 17, which includes a background compensating selector circuit connected to the output of said scaling network to prevent said output from decreasing to zero, when no object is being scanned in the counting area.

19. Apparatus as set forth in claim 18, wherein the decrease of said output is prevented from going below substantially 0.37 volts.

20. Apparatus as set forth in claim 1, in which said logic circuit means comprises accumulator means for storing certain of the group binary pulse values from a present scan, and other of the group binary pulse values from a previous scan.

21. Apparatus as set forth in claim 1, in which said logic circuit means comprises a shift register for storing output binary pulse values of a previous scan; a shift register for storing certain of the binary pulse values of the group pattern from a present scan; and a shift register for storing certain other of the binary pulse values of the group pattern from the previous scan shift register.

22. Apparatus as set forth in claim 20, wherein the group pattern comprises seven binary pulse values, four of which are taken from a present scan and three of which are taken from a previous scan.

23. Apparatus as set forth in claim 1, in which the output of the decoding means is connected to a shift register to prevent the output of spurious counting pulses during input signal transitions thereto; and in which the output of said shift register connects with a line driver to enable transmission of the counting pulses to remotely located counting means.

24. The method of counting randomly arranged generally spheroidal or ellipsoidal objects, which comprises the steps of:

(a) continuously moving the randomly arranged objects across an elongated transverse illuminated counting area;

(b) sensing the illumination levels in successively scanned discrete divisional areas in a single longitudinal scanning path of the counting area;

(c) generating a series of timed binary signal pulses corresponding to the respective illumination levels of said discrete divisional areas in said scanning path, and in which the binary signal will have a digital logic value of "1" when the illumination level varies in one direction from a predetermined value, and a digital logic value of "0" when the illumination level varies in an opposite direction from the predetermined value;

(d) selectively grouping certain of the binary signal pulse values of successive scans into a recognition pattern having a configuration such that it will occur only once for each object traversing the counting area; and (e) thereafter decoding the binary pulse values of each recognition group to provide an output counting pulse.

25. The method as set forth in claim 24, wherein the sensed illumination levels during each scan are translated into analog voltage pulses which are each compared with an analog voltage pulse corresponding to said predetermined illumination level to determine the character of the corresponding generated binary signal pulse.

* * * * *

UNITED STATES PATENT AND TRADEMARK OFFICE

CERTIFICATE OF CORRECTION

PATENT NO. : 4,139,766

DATED : February 13, 1979

INVENTOR(S) : TIM D. CONWAY

It is certified that error appears in the above-identified patent and that said Letters Patent are hereby corrected as shown below:

Column 7, line 1, "64-shaft" should read --64-bit shaft --.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*